US012716622B2

(12) United States Patent
Lycklama a Nijeholt et al.

(10) Patent No.: US 12,716,622 B2
(45) Date of Patent: Aug. 25, 2026

(54) DEVICE FOR THE SUPPRESSION OF ACOUSTIC STREAMING IN THERMOACOUSTIC SYSTEMS

(71) Applicant: Nederlandse Organisatie voor toegepast-natuurwetenschappelijk Onderzoek TNO, 's-Gravenhage (NL)

(72) Inventors: Jan-Aiso Lycklama a Nijeholt, Petten (NL); Moulay EL Hassan Tijani, Petten (NL)

(73) Assignee: Nederlandse Organisatie voor toegepast-natuurwetenschappelijk Onderzoek TNO, 's-Gravenhage (NL)

( * ) Notice: Subject to any disclaimer, the term of this patent is extended or adjusted under 35 U.S.C. 154(b) by 636 days.

(21) Appl. No.: 17/766,749

(22) PCT Filed: Oct. 8, 2020

(86) PCT No.: PCT/EP2020/078328
§ 371 (c)(1),
(2) Date: Apr. 6, 2022

(87) PCT Pub. No.: WO2021/069618
PCT Pub. Date: Apr. 15, 2021

(65) Prior Publication Data

US 2024/0093917 A1 Mar. 21, 2024

(30) Foreign Application Priority Data

Oct. 8, 2019 (EP) ..... 19202035

(51) Int. Cl.
*F25B 9/14* (2006.01)

(52) U.S. Cl.
CPC ..... *F25B 9/145* (2013.01); *F25B 2309/1405* (2013.01); *F25B 2309/1416* (2013.01)

(58) Field of Classification Search
CPC ..... F25B 9/145; F25B 2309/1405; F25B 2309/1416
See application file for complete search history.

(56) References Cited

U.S. PATENT DOCUMENTS 6,732,515 B1 * 5/2004 Weiland ..... F02G 1/0435 60/520
2016/0090970 A1 * 3/2016 Miyairi ..... F03G 7/00 60/530

FOREIGN PATENT DOCUMENTS

CN 2879052 Y * 3/2007
CN 104913537 B 6/2017
(Continued)

OTHER PUBLICATIONS

Qiu, Hot sound-driven vessel refrigeration machine system pre-cooled by G-M type vessel refrigeration machine, 2006, Full Document (Year: 2006).*
(Continued)

*Primary Examiner* — Nael N Babaa
(74) *Attorney, Agent, or Firm* — Ipsilon USA—NLO

(57) ABSTRACT

A thermoacoustic system for transfer of energy by an acoustic wave, includes a process volume. The process volume is filled with a fluid through which the acoustic wave propagates, and includes an acoustic network including a compliance volume, a thermoacoustic core and a fluidic inertia; the thermoacoustic core including a cold heat exchanger, a hot heat exchanger and a regenerator; the cold heat exchanger arranged on a first side of the hot heat exchanger with the regenerator between the hot and cold heat exchangers; a thermal buffer zone is positioned adjoining the hot heat exchange on a second side thereof. The thermoacoustic system includes a partitioning element that is arranged in the thermal buffer zone adjacent to the hot heat exchanger. The partitioning element is configured for block-
(Continued)

ing mass flow of the fluid through the thermal buffer zone in a direction of acoustic wave propagation in the thermal buffer zone, while allowing passage of the acoustic wave through the thermal buffer zone.

14 Claims, 5 Drawing Sheets

(56) References Cited

FOREIGN PATENT DOCUMENTS

| | | | | | |
|---|---|---|---|---|---|
| GB | 2269225 | A | * | 2/1994 | ..... F25D 19/006 |
| JP | 2019 168207 | A | | 10/2019 | |
| WO | 2016/091900 | A1 | | 6/2016 | |

OTHER PUBLICATIONS

Kazuki, Superconductive Magnet, 1994, Full Document (Year: 1994).*

* cited by examiner

DEVICE FOR THE SUPPRESSION OF ACOUSTIC STREAMING IN THERMOACOUSTIC SYSTEMS

FIELD OF THE INVENTION

The present invention relates to a thermoacoustic system according to the preamble of claim 1. Additionally, the invention relates to a method for manufacturing such a thermoacoustic system.

BACKGROUND

FIG. 1A and FIG. 1B show a cross-section of a schematic thermoacoustic system configured as a prior art thermoacoustic engine 11 and a prior art thermoacoustic heat pump 12, respectively.

The thermoacoustic system 11, 12 has process volume 130 which is filled with a working fluid, for example a pressurized gas such as helium.

The design of the thermoacoustic system 11, 12 is based on a thermoacoustic network. This network consists of the following components: a thermoacoustic core 140, a compliance, and an inertance.

The thermoacoustic core comprises a cold heat exchanger 102, a regenerator 106, and a hot heat exchanger 104. The regenerator 106 is placed between the cold heat exchanger 102 and the hot heat exchanger 104. Next to the hot heat exchanger 104 on a second side opposite the first side, a thermal buffer zone, TBZ, 108 is arranged. The thermal buffer zone 108 extends between the hot heat exchanger 104 and a TBZ heat exchanger 112. The thermal buffer zone minimizes heat leakage from the hot heat exchanger 104 into the remaining part of the thermoacoustic engine and therefore prevents the heat-up of the engine and insulates the hot heat exchanger 104. The optional thermal buffer zone heat exchanger 112 removes any heat leakage from the hot heat exchanger 104 into the thermal buffer zone 108. Under ideal circumstance, gas in the TBZ oscillates as plug flow along the length of the TBZ 108 and heat conduction through the gas and the wall of the TBZ 108 is very small. However, the performance of such a thermoacoustic system (i.e., thermoacoustic engine 11 or thermoacoustic heat pump 12) can be severely degraded by a high degree of heat leakage that is caused by the presence of streaming in the thermal buffer zone 108.

Streaming within the thermal buffer zone 108 refers to a time-averaged mass circulation 110 (streaming vortex) or mass flow, as schematically shown in FIGS. 1A and 1B. The time-averaged mass flow based on the mass circulation associated with the streaming vortex effectively convects heat away from the hot heat exchanger 104. The convected heat is lost and thus will substantially not contribute to the thermoacoustic conversion process in the thermoacoustic system. The mass flow creates a high heat leakage that can seriously degrade the performance of the thermoacoustic system 11, 12.

From experiments with a thermoacoustic engine it was shown that heat leakage can be as high as 70% of the heat input to the thermoacoustic engine. Computational Fluid Dynamics (CFD-) simulations of a thermoacoustic engine showed the presence of a large time-averaged vortex 110 in the TBZ 108. The simulations showed that the junction below 112 is causing the streaming due to an asymmetric velocity profile when the flow oscillates up and down. A streaming vortex was found in several geometrical designs of the acoustic loop.

In prior art literature other types of streaming characterized by alternative flow mechanisms are reported and several countermeasures are proposed to reduce the effect of streaming in the TBZ. However, these measures cannot prevent the streaming vortex 110.

Mass streaming or Gedeon streaming is a net time-averaged mass flow which circulates around the acoustic loop of the thermoacoustic system and this streaming is commonly called "DC-flow". An elastic membrane or jet pump is usually used in prior art to suppress the DC-flow. The membrane or jet pump is placed at a location of low velocity to minimize the acoustic losses. Rayleigh streaming is caused by viscous and thermal boundary layer effects and from asymmetric oscillations of the acoustic wave. A tapered tube has been used to minimize this type of streaming in the TBZ. By optimally varying the cross-sectional radius of the tapered tube over the tube's length, the streaming vortex in the TBZ can be effectively reduced. The optimum taper angle is a function of the acoustic pressure. It appears to be not possible however, or at least very complex, to design a tapered tube which can be used optimally for a TBZ over a range of acoustic operation conditions. Jet streaming is caused by sudden flow contractions which causes a jet type of flow. The jet causes a non-uniform flow profile and net streaming flow pattern. Flow straighteners are typically used to redistribute the jet and to minimize this effect of the non-uniform flow profile. The flow straightener is a porous structure; usually a stack of screens. The effectiveness of the flow straighteners however is dependent on the flow conditions which change when the acoustic conditions change (acoustic pressure amplitude). It appears not possible to design flow straighteners that can operate efficiently for different acoustic conditions. Additionally, the flow straighteners can only minimize the effect of the jets on the vortex but can not completely suppress the vortex in the TBZ.

The skilled in the art will appreciate that a streaming vortex or any other of the streaming types also can exist at the compliance side of the acoustic core. Thus, in case of a thermoacoustic heat pump delivering useful heat, some heat is lost by a flow related to the streaming at this position. Hereafter, streaming will also be referred to as mass flow.

It is an object of the present invention to provide a thermoacoustic system that overcomes or mitigates the above detrimental effects.

SUMMARY OF THE INVENTION

The above object is achieved by a thermoacoustic system in accordance with claim 1.

The invention provides that the partitioning element divides the process volume (also referred to as thermal tube volume), in sub-volumes separated from each other. The partitioning element is designed to block streaming of the working fluid between the sub-volumes by closing off the cross-section of the pipe section of the process volume where the thermoacoustic core is located. In other words, the flow of gas (mass flow), is interrupted between the two sub-volumes. At the same time the partitioning element is acoustically transparent and allows acoustic waves to pass between the hot heat exchanger and the cold heat exchanger and vice versa.

In this manner, the mass flow of the streaming vortex is blocked and the convective heat flow between the hot heat exchanger and the thermal buffer zone heat exchanger is strongly reduced. As a result, less heat leaks away from the hot heat exchanger and more heat will be available to contribute to the thermoacoustic conversion process in the regenerator, thus improving the efficiency of the thermoacoustic system.

Also, the present invention relates to a method for manufacturing the thermoacoustic system as defined above.

Advantageous embodiments are further defined by the dependent claims.

BRIEF DESCRIPTION OF DRAWINGS

The invention will be explained in more detail with reference to drawings in which illustrative embodiments thereof are shown. They are intended exclusively for illustrative purposes and not to restrict the inventive concept, which is defined by the appended claims.

In FIGS. 1A-5B elements with the same reference number refer to corresponding or similar elements.

DETAILED DESCRIPTION OF EMBODIMENTS

Figure 2A:
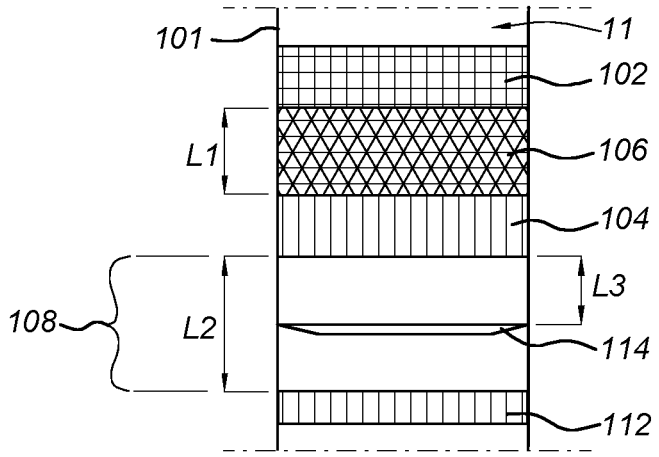
FIGS. 2A and 2B show a schematic cross-section of a thermoacoustic core in accordance with a respective embodiment of the invention.
Figure 2B:
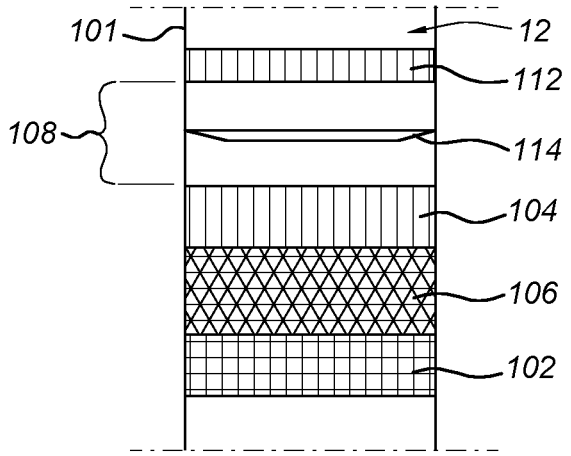

FIGS. 2A and 2B show a schematic cross-section of a thermoacoustic core 140 in accordance with an embodiment of the invention for a thermoacoustic engine 11 and a thermoacoustic heat pump 12, respectively.

A thermoacoustic core 140 may be part of either a thermoacoustic engine configuration or a thermoacoustic heat pump configuration.

The thermoacoustic core 140 is arranged within a pipe portion 101 of the process volume and comprises a cold heat exchanger 102, a hot heat exchanger 104, a regenerator 106, and a thermal buffer zone heat exchanger 112.

The cold heat exchanger 102 is arranged in the pipe portion 101 at a first distance L1 from a first side of the hot heat exchanger 104. At an opposite second side of the hot heat exchanger 104 at a second distance L2 the thermal buffer zone heat exchanger 112 is arranged. The regenerator 106 is positioned between the hot heat exchanger 104 and the cold heat exchanger 102.

The designation of "cold heat exchanger" and "hot heat exchanger" refers to the relative temperatures of the respective heat exchangers during use: in use the cold heat exchanger 102 will have a lower temperature than the temperature of the hot heat exchanger 104.

The pipe portion 101 in which the cold, hot and buffer zone heat exchangers 102, 104, 112 are arranged is filled during use with a working fluid, typically a gas. Such a gas may comprise helium, and may be pressurized, for example at about 50 bar (~5 MPa).

As explained in the introductory part, in the thermoacoustic core of the prior art thermoacoustic system, a streaming vortex or turbulence 110 in the gas can occur during use, which causes leakage of energy (heat) from the thermoacoustic conversion process between the cold and hot heat exchangers 102, 104.

According to the invention, the thermoacoustic core 140 comprises a partitioning element 114 which is arranged in the pipe portion 101 between the hot heat exchanger 104 and the buffer zone heat exchanger 112 for blocking or suppressing the streaming vortex 110, and thus the mass flow. The partitioning element 114 is arranged at a distance L3 from the hot heat exchanger 104, but the distance L3 of the partitioning element 114 to the hot heat exchanger 104 is shorter than the second distance L2.

The partitioning element 114 is configured to block the circulating mass flow of the streaming vortex 110 in the gas between the hot heat exchanger 104 and the thermal buffer zone heat exchanger 112.

Advantageously, by blocking the mass flow the leakage of heat is significantly reduced. In addition, the partitioning element 114 is configured as an acoustic transparent element. By this property the partitioning element 114 allows that acoustic waves running between the hot heat exchanger 104 and the thermal buffer zone heat exchanger 112 can pass the partitioning element 114 without much disturbance, i.e., with minimal loss of acoustic energy As a result, the propagation of acoustic waves through the thermoacoustic core 140 and through the thermoacoustic system 11; 12 as a whole is not affected.

Due to the blocking of the streaming vortex 110 and the reduction of heat loss, the efficiency of the thermoacoustic system 11; 12 is increased.

Figure 1A:
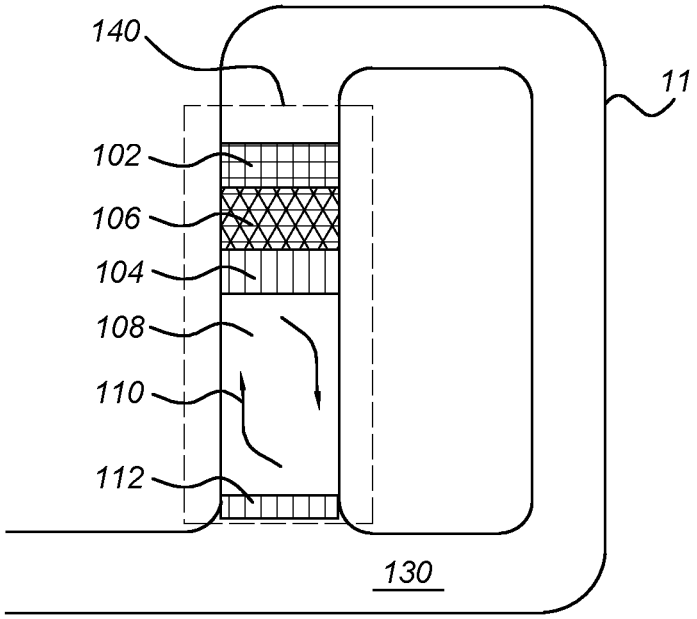
FIGS. 1A and 1B show a schematic cross-section of a thermoacoustic system configured as prior art thermoacoustic engine and prior art thermoacoustic heat pump respectively.
Figure 1B:
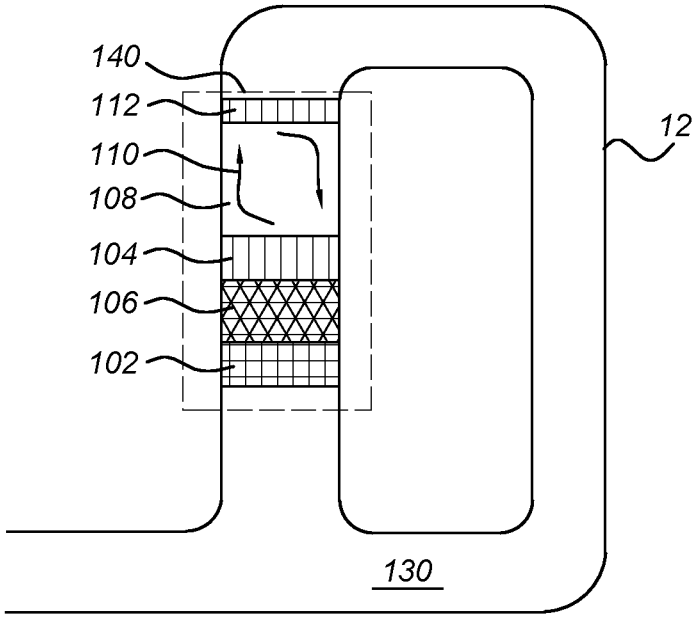

The increased efficiency allows to scale down the thermal buffer zone 108 and as a result, design a more compact thermoacoustic system. Also, the resonator volume which can be coupled to the right side of the loop at the junction (in FIG. 1A, 1B), can be scaled down. Overall, the cost of the thermoacoustic system according to the invention can be lowered relative to a prior art thermoacoustic system of comparable (thermal) power.

The partition element 114 is preferably made of a material with a low thermal conductivity or it can be provided with a thermally insulating material which provides an additional resistance to heat flowing from the hot heat exchanger 104 to the thermal buffer zone heat exchanger 112. Example materials with thermal insulation behaviour and sufficient stiffness are composite materials like Teflon, Peek, Acetal, etc.

Figure 3A:
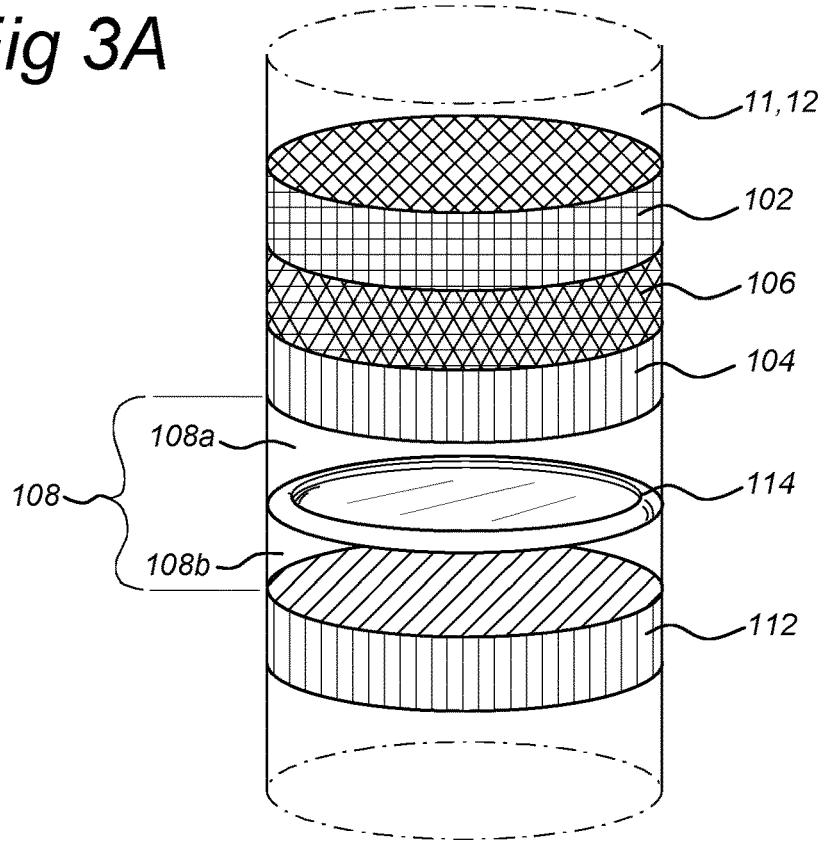
FIG. 3A, 3B, 3C show a perspective view of the thermoacoustic core equipped with a partitioning element according to an embodiment, a perspective view and a plane view of such a partitioning element, respectively.
Figure 3B:
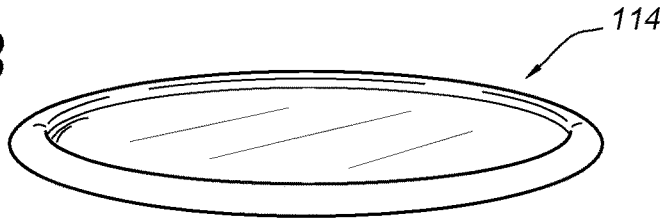
Figure 3C:
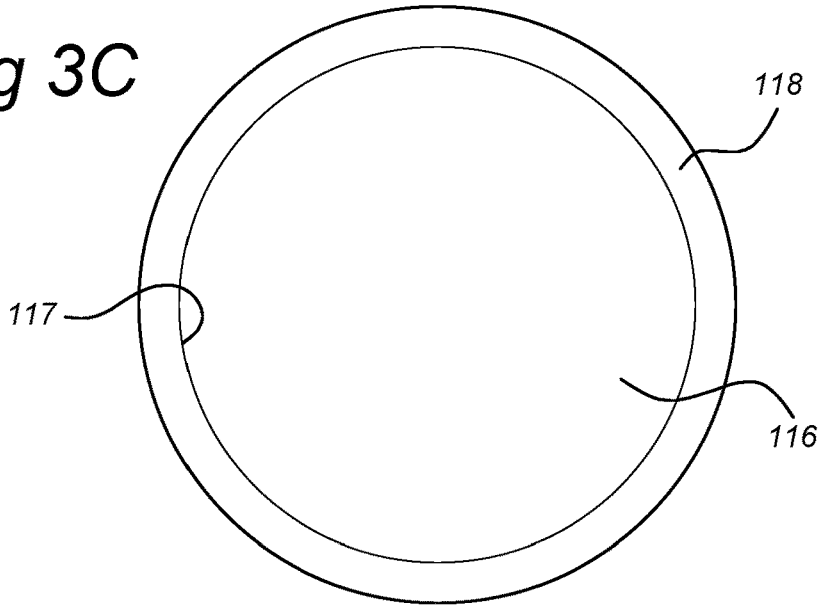

FIG. 3A, 3B, 3C show a perspective view of the thermoacoustic core equipped with a partitioning element according to embodiment, a perspective view and a plane view of such a partitioning element, respectively.

In FIG. 3A, a perspective view of the pipe portion 101 holding the thermoacoustic core 140 is shown, which thermoacoustic core comprises, in FIG. 3A from top to bottom, the cold heat exchanger 102, the regenerator 106, the hot heat exchanger 104, the thermal buffer zone 108, and a thermal buffer zone heat exchanger 112. The partitioning element 114 is arranged within the thermal buffer zone 108.

Preferably, the partitioning element 114 closes off the pipe portion 101 in the thermal buffer zone 108. In this case, the partitioning element 114 has a cross-section equal to a cross-section within the thermal buffer zone 108, i.e., the pipe portion between the hot heat exchanger 104 and the thermal buffer zone heat exchanger 112.

The partitioning element 114 is designed to cover the cross-section within the thermal buffer zone 108 and to attach entirely to the wall of the pipe portion at the level of the covered cross-section of the thermal buffer zone 108. In this manner the thermal buffer zone is divided in two sub-volumes 108*a*, 108*b* separated from each other. The division prevents flow of the working fluid between the two sub-volumes 108*a*, 108*b*.

As shown in FIGS. 3B and 3C, the partitioning element 114 comprises a central section 116 and an outer annular section 118 joined to a circumference 117 of the central section 116. The outer annular section 118 is to be attached to the wall of the pipe portion in the thermal buffer zone 108. Alternatively, the central section 116 and the outer annular section 118 can be indirectly connected to each other by means of an intermediate element between the central section 116 and the outer annular section 118.

It is noted that in this embodiment, the partitioning element 114 has a substantially circular shape which is suitable for covering and closing off a circular cross-section within the thermal buffer zone 108. The skilled in the art will appreciate that for other non-circular cross-sections of the thermal buffer zone, the cross-section of the partitioning element 114 can be adapted to fit.

Figure 4A:
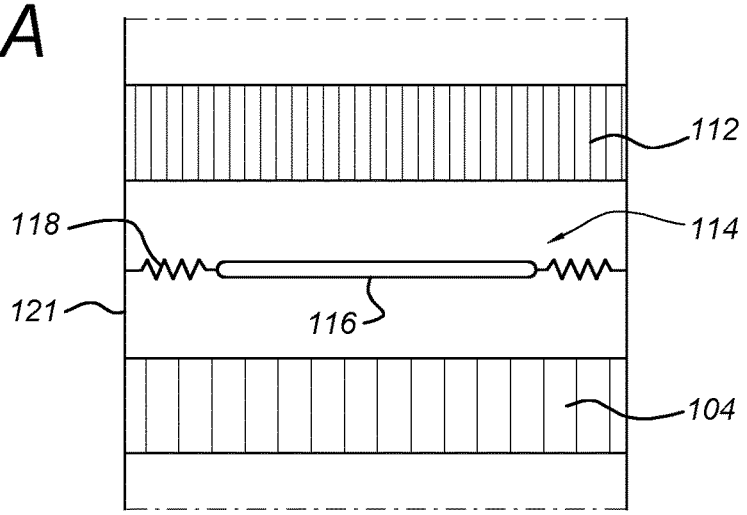
FIGS. 4A-4C show schematic cross-sections of a thermoacoustic partitioning element in accordance with an embodiment of the invention for a thermoacoustic heat engine and thermoacoustic heat pump, respectively.
Figure 4B:
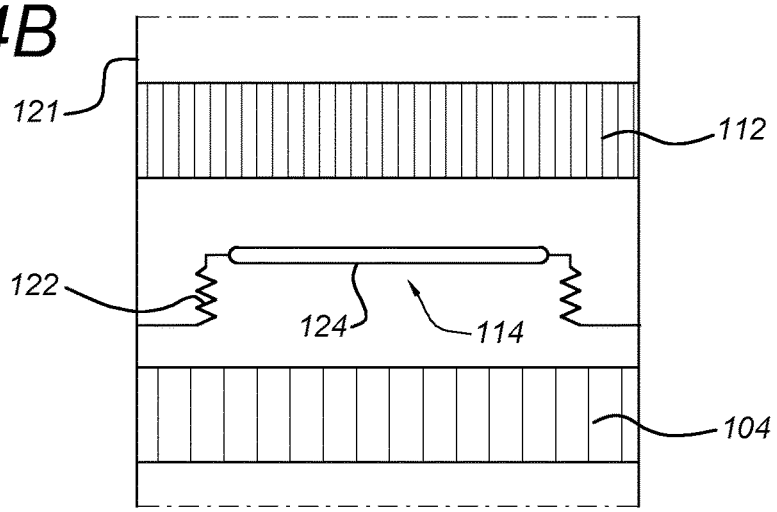
Figure 4C:
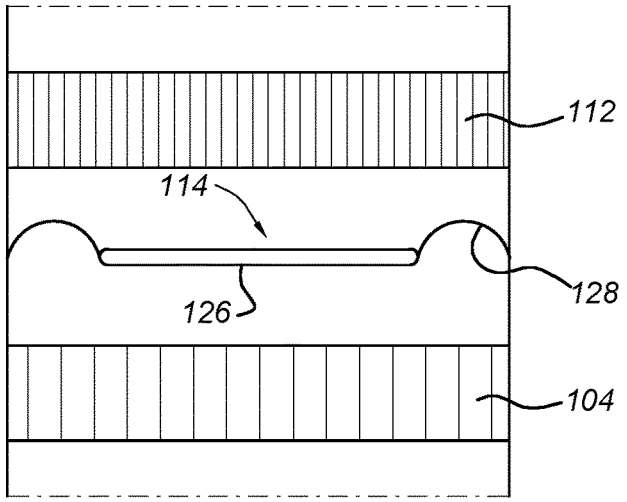

FIGS. 4A-4C show schematic cross-sections of a thermoacoustic partitioning element in accordance with an embodiment of the invention for a thermoacoustic heat engine or a thermoacoustic heat pump, respectively.

In an embodiment, the diameter of the thermal buffer zone 108 is circular, and the partitioning element 114 has a central circular portion 116 attached to an outer annular suspension 118. This configuration is schematically shown in FIG. 4A. The outer annular suspension 118 provides a flexible connection of the central circular portion 116 to the wall 121 of the thermal buffer zone 108. In this manner, the pipe portion 101 is closed off for streaming (mass flow) and blocks a flow of gas between the heat exchangers 104, 112 while the flexible connection by the annular suspension 118 provides that the central circular portion 116 of the partitioning element 114 can move in phase with the acoustic wave propagating through the thermoacoustic system.

The annular suspension 118 may be an elastic ring to provide the flexible connection. Alternatively, an intermediate element (not shown) may be provided to connect the elastic ring with the central circular portion 116. An outer circumference of the intermediate element is connected to an inner circumference of the elastic ring, while the inner circumference of the intermediate element is connected with an outer circumference of the central circular portion 116.

FIG. 4B shows an embodiment of the partitioning element 114 that is constructed as a bellows 122 with a relatively stiff center plate 124, which bellows 122 is suspended at the wall 121 of the pipe portion 101 in the thermal buffer zone 108 between the hot heat exchanger 104 and the thermal buffer zone heat exchanger 112, such that the center plate 124 can move by acoustic waves propagating in the thermoacoustic system.

Alternatively, as shown in FIG. 4C the partitioning element 114 can be embodied by a loudspeaker cone 126 of which the circumference 128 is suspended at the wall 121 of the pipe section 101 in the thermal buffer zone 108 between the hot heat exchanger 104 and the thermal buffer zone heat exchanger 112.

Figure 5A:
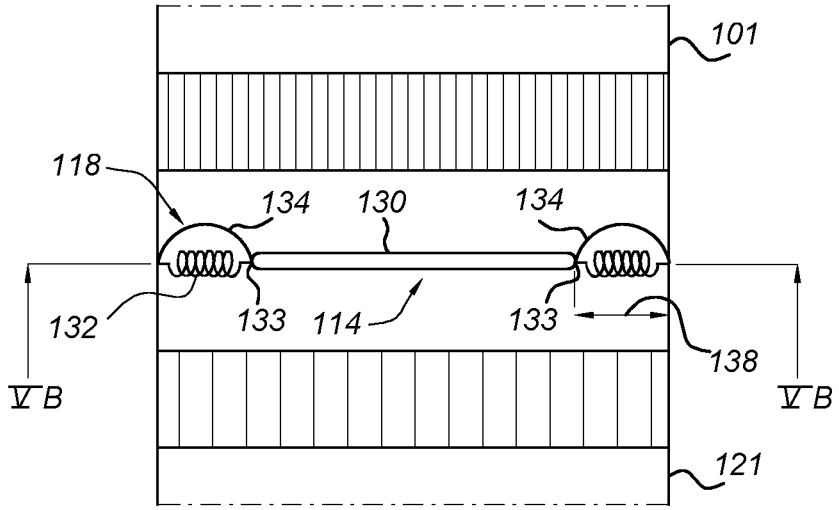
FIGS. 5A, 5B show schematically cross-sections of a thermoacoustic partitioning element in accordance with an embodiment of the invention.
Figure 5B:
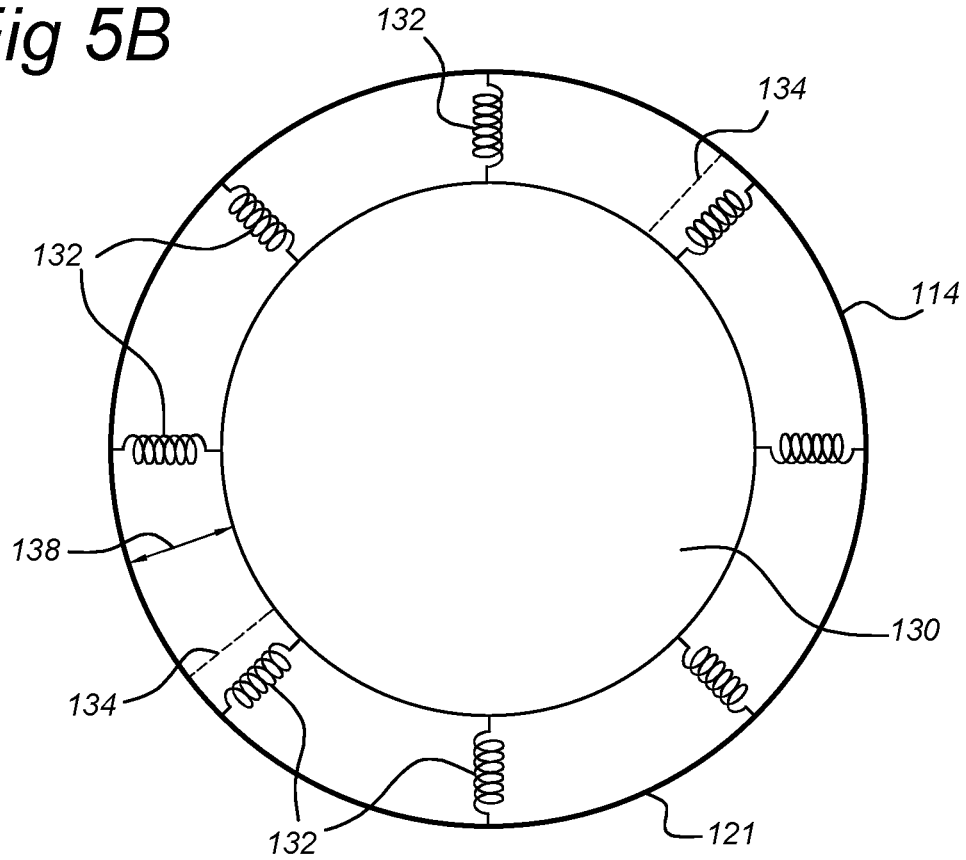

FIGS. 5A, 5B show schematic cross-sections of a thermoacoustic partitioning element in accordance with an embodiment of the invention.

As shown in FIGS. 5A, 5B, the partitioning element 114 comprises a central disc 130 (plate) with radial springs 132 for connecting the central disc 130 to the surrounding wall 121 of the thermal buffer zone. A flexible membrane or sheet 134 is provided between the periphery 133 of the central disc 130 and the surrounding wall 121 to seal the gap 138 between the disc 130 and the wall 121 and to prevent mass flow through the gap. The flexible membrane or sheet 134 is configured to allow the excursion of the oscillating displacement of the central disc 130 for acoustic waves passing the disc. Advantageously, this concept is easy to scale up.

According to an embodiment, the central portion 116, 124, and 126 has a significant mass and the annular suspension have a significant stiffness which combination can be seen as a mass-spring system which is transparent to the wave by resonating at the same frequency as the acoustic working frequency of the system.

According to an alternative embodiment, the partitioning element is arranged in a second thermal buffer zone (not shown) adjacent to the cold heat exchanger, at a side thereof that faces away from the hot heat exchanger. In this embodiment, the partitioning element is configured to block streaming and mass flow through the second thermal buffer zone.

In the foregoing description of embodiments, the invention has been described with reference to specific embodiments thereof. It will, however, be evident that various modifications and changes may be made thereto without departing from the scope of the invention as summarized in the attached claims.

In particular, combinations of specific features of various aspects of the invention may be made. An aspect of the invention may be further advantageously enhanced by adding a feature that was described in relation to another aspect of the invention.

In addition, modifications may be made to adapt a particular layout or material to the teachings of the invention without departing from the essential scope thereof. Therefore, it is intended that the invention not be limited to the particular embodiments disclosed, but that the invention includes all embodiments falling within the scope of the appended claims.

The invention claimed is:

1. A thermoacoustic system for transfer of energy by an acoustic wave, comprising a process volume, the process volume being filled with a working fluid through which the acoustic wave propagates comprising an acoustic network comprising a compliance volume, a thermoacoustic core, and a fluidic inertia;

the thermoacoustic core comprising, in a pipe section of the process volume, at least a cold heat exchanger, a hot heat exchanger and a regenerator; the cold heat exchanger arranged on a first side of the hot heat exchanger with the regenerator positioned between the hot heat exchanger and the cold heat exchanger; a thermal buffer zone positioned adjoining the hot heat exchanger on a second side opposite the first side of the hot heat exchanger;

wherein the thermoacoustic system comprises a partitioning element; the partitioning element is arranged in the thermal buffer zone adjacent to the hot heat exchanger and the partitioning element is configured for closing off a cross-section of the pipe section and blocking mass flow of the working fluid through the thermal buffer zone, while allowing passage of the acoustic wave through the thermal buffer zone, wherein the partitioning element divides the thermal buffer zone into two sub-volumes separated from each other, wherein the partitioning element blocks a streaming vortex or time-averaged mass circulation of the working fluid between the hot heat exchanger and the thermal buffer zone heat exchanger, and wherein the partitioning element is made of a thermally insulating material, wherein the partitioning element provides thermal insulation between the hot heat exchanger and the thermal buffer zone heat exchanger.

2. The thermoacoustic system according to claim 1, wherein the thermoacoustic system comprises the thermal buffer zone heat exchanger arranged in the thermal buffer zone, and the partitioning element is arranged between the thermal buffer zone heat exchanger and the hot heat exchanger.

3. The thermoacoustic system according to claim 1, wherein the partitioning element is transparent for acoustic waves.

4. The thermoacoustic system according to claim 1, wherein the partitioning element comprises a peripheral suspension portion, which is arranged to seal off against a wall of the pipe section in the thermal buffer zone.

5. The thermoacoustic system according to claim 4, wherein the partitioning element additionally comprises a central portion, which is configured to connect with the peripheral suspension portion.

6. The thermoacoustic system according to claim 5, wherein the peripheral suspension portion is sealably connected to an outer circumference of the central portion.

7. The thermoacoustic system according to claim 5, wherein the peripheral suspension portion is connected to an outer circumference of the central portion by an intermediate element which is sealably connected to an outer circumference of the central portion at one side and to an inner circumference of the peripheral suspension portion at a second side.

8. The thermoacoustic system according to claim 4, wherein the peripheral suspension portion is an elastic ring.

9. The thermoacoustic system according to claim 5, wherein the central portion is a disc or a plate, and the peripheral suspension portion comprises radial springs attaching the central portion to the wall of the thermal buffer zone and a peripheral flexible membrane, which seals a gap between the disc and the wall.

10. The thermoacoustic system according to claim 1, wherein the partitioning element is a bellows.

11. The thermoacoustic system according to claim 1, wherein the partitioning element is a speaker cone.

12. The thermoacoustic system according to claim 5, wherein the cross section of the thermal buffer zone is circular, the central portion of the partitioning element is a central circular portion, and the peripheral suspension portion is a circular annular suspension portion.

13. The thermoacoustic system according to claim 1, wherein a resonance eigenfrequency of the partitioning element matches with an eigenfrequency of the acoustic network of the thermoacoustic system.

14. The thermoacoustic system according to claim 1, wherein the partitioning element is made of one of Teflon, Peek, or Acetal.

* * * * *